US010604387B2

(12) United States Patent
Hamaguchi

(10) Patent No.: US 10,604,387 B2
(45) Date of Patent: Mar. 31, 2020

(54) CRANE

(71) Applicant: KOBELCO CONSTRUCTION MACHINERY CO., LTD., Hiroshima-shi (JP)

(72) Inventor: Hiromitsu Hamaguchi, Hyogo (JP)

(73) Assignee: KOBELCO CONSTRUCTION MACHINERY CO., LTD., Hiroshima-shi (JP)

( * ) Notice: Subject to any disclaimer, the term of this patent is extended or adjusted under 35 U.S.C. 154(b) by 243 days.

(21) Appl. No.: 15/661,547

(22) Filed: Jul. 27, 2017

(65) Prior Publication Data

US 2018/0029853 A1 Feb. 1, 2018

(30) Foreign Application Priority Data

Aug. 1, 2016 (JP) ..... 2016-151382

(51) Int. Cl.

| | |
|---|---|
| ***B66C 23/88*** | (2006.01) |
| ***B66C 13/16*** | (2006.01) |
| ***B66C 13/18*** | (2006.01) |
| ***B66C 13/22*** | (2006.01) |
| ***B66C 13/46*** | (2006.01) |
| ***B66C 23/36*** | (2006.01) |
| ***B66C 23/82*** | (2006.01) |

(52) U.S. Cl.

CPC ..... *B66C 23/88* (2013.01); *B66C 13/16* (2013.01); *B66C 13/18* (2013.01); *B66C 13/22* (2013.01); *B66C 13/46* (2013.01); *B66C 23/36* (2013.01); *B66C 23/82* (2013.01); *B66C 23/823* (2013.01)

(58) Field of Classification Search

CPC ..... B66C 23/00; B66C 23/06; B66C 23/36; B66C 23/62; B66C 13/00; B66C 13/06; B66C 13/18

See application file for complete search history.

(56) References Cited

FOREIGN PATENT DOCUMENTS

| | | | |
|---|---|---|---|
| DE | 202 15 179 U1 | | 2/2004 |
| JP | 59-15686 U | | 1/1984 |
| JP | 2005194088 A | * | 7/2005 |
| JP | 2011219213 A | * | 11/2011 |
| JP | 2015157695 A | * | 9/2015 |

OTHER PUBLICATIONS

NPL machine translation of Yotawara (JP-2005194088-A) document attached.*

NPL machine translation of Hamaguchi (JP-2011219213-A) document attached.*

NPL machine translation of Akira (JP-2015157695-A) document attached.*

* cited by examiner

*Primary Examiner* — Mahmoud S Ismail
*Assistant Examiner* — Bakari Underwood
(74) *Attorney, Agent, or Firm* — Oblon, McClelland, Maier & Neustadt, L.L.P.

(57) ABSTRACT

There is provided a crane that is capable of adjusting the warp of a raising member mounted on a supporting body to be raised and lowered, where the adjustment is made according to a posture of the raising member and load of a cargo. The crane includes a crane body, a boom, a raising device, a main rope, a main winch, a mid-support rope, a mid-support winch, and a manipulation unit. The mid-support rope connects a middle portion of the boom to the guylink and includes a securing end P secured to the guylink. The mid-support winch winds up and winds out the mid-support rope to change the distance between the guylink and the boom.

6 Claims, 7 Drawing Sheets

CRANE

TECHNICAL FIELD

The present invention relates to a crane including a raising member and capable of lifting a cargo.

BACKGROUND ART

Conventionally, as a walking crane which is one type of cranes, a walking crane including a crane body and a boom serving as a raising member has been known. The boom is mounted on the front portion of the crane body to be raised or lowered. A cargo is lifted by a wire hung from the distal end of the boom. The long boom warps by some degree by its own weight. When the cargo is lifted with the boom warped, a compression force is applied to the boom along the longitudinal direction of the boom. This results in a large bending moment in the middle portion of the boom, which requires the boom to have high strength.

JP S59-15686 U discloses a crane including a jib serving as a raising member pivotably supported by the distal end of the boom. A guyline for raising and lowering the jib is connected to the distal end of the jib. A mid-support line is provided to connect the middle portion of the guyline and the middle portion of the jib. The mid-support line reinforces the supporting structure of the jib to suppress the warp of the jib.

DE 20215179 U1 discloses a crane including a boom, a mast for raising and lowering the boom, and a rope-shape guyline connecting the distal end of the boom and the distal end of the mast. The guyline extends from the distal end of the mast to the distal end of the boom to run about a sheave provided at a mid-branch-point and then to the middle portion of the boom. The guyline runs about a mid-sheave provided on the middle portion of the boom and back to the sheave at the mid-branch-point and is connected to the distal end of the boom.

In the art disclosed in JP S59-15686 U, each of both ends of the mid-support line is respectively secured to the jib and the guyline. The degree of warp of the jib changes with the raised angle of the jib and the weight of a cargo. Thus, with both the ends of the mid-support line secured, the degree of warp of the jib disadvantageously cannot be suppressed to a minimum for different raised angles of the boom and different weights of the cargo.

In the art disclosed in DE 20215179 U1, the distance between the sheave at the mid-branch-point and the mid-sheave on the boom changes as the tension of the guyline increases or decreases to raise and lower the boom. For this reason, the warp of the boom cannot be corrected by adjusting the distance between the sheaves while the raised angle of the boom is kept constant. Disadvantageously, the degree of warp of the boom cannot be suppressed to a minimum for different raised angles of the boom and different weights of the cargo.

SUMMARY OF INVENTION

The present invention has been made in view of the aforementioned problem. An object of the present invention is to provide a crane capable of adjusting the warp of a raising member mounted on a supporting body to be raised and lowered according to a posture of the raising member and weight of a cargo.

A crane according to one aspect of the present invention includes a raising member, a supporting body, a raising device, a lift rope, a lift winch, a mid-support rope, a constraining unit, and a mid-support winch. The raising member includes a distal end and a proximal end and extends in the longitudinal direction. The supporting body supports the raising member to be raised and lowered. The raising device includes a connecting member having a first end and a second end, the first end being connected to the distal end of the raising member, the second end being located in an opposite side of the first end, and a pull unit connected to the second end of the connecting member to pull the connecting member. The raising device adjusts a force with which the connecting member pulls the raising member to raise the raising member. The lift rope is hung from the distal end of the raising member to lift a cargo. The lift winch winds up and winds out the lift rope. The mid-support rope connects a middle portion of the raising member to the connecting member and includes a securing end secured to the connecting member at a point between the first end and the second end of the connecting member. The constraining unit is disposed on a middle portion of the raising member to constrain the mid-support rope. The mid-support winch winds up and winds out the mid-support rope constrained by the constraining unit to change a distance between the connecting member and the constraining unit.

DESCRIPTION OF EMBODIMENTS

Figure 1:
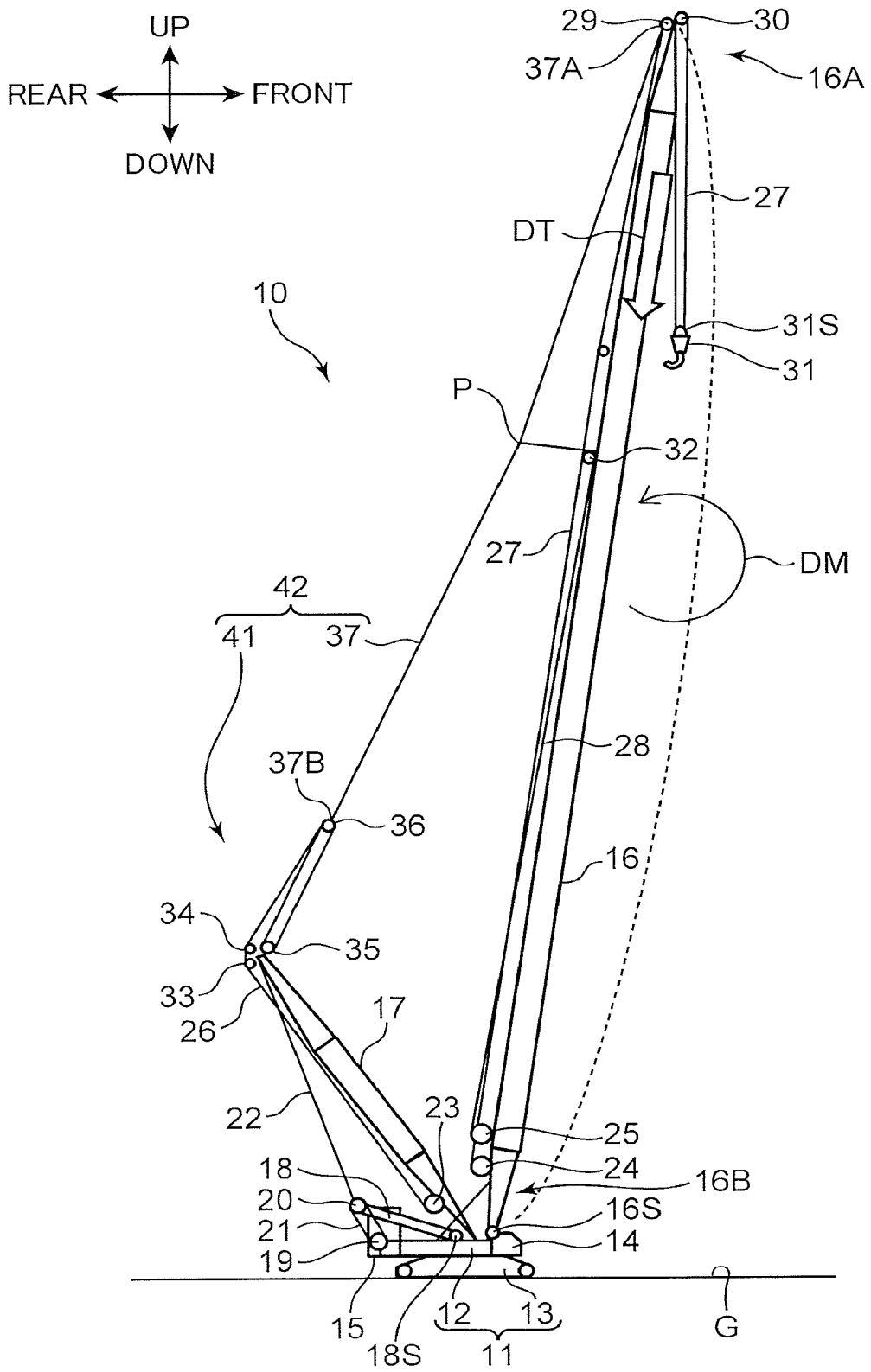
FIG. 1 is a side view of a crane according to an embodiment of the present invention.

Embodiments according of the present invention will now be described with reference to the drawings. FIG. 1 is a side view of a crane 10 according to an embodiment of the present invention. Directions "UP", "DOWN", "FRONT", and "REAR" are shown in the drawings to illustrate the structure and the method of assembling of the crane 10 according to the embodiment, for convenience. The directions do not limit the walking directions and operation modes of the crane 10 according to the present invention.

The crane 10 includes a crane body 11 (supporting body). The crane body 11 includes an upper swing body 12 and a lower traveling body 13 that swingably supports the upper swing body 12. The crane 10 includes a cab 14, a counter weight 15, a boom 16 (raising member), a lattice mast 17, and a box mast 18.

The cab 14 is disposed on the front end of the upper swing body 12. The cab 14 serves as an operator cockpit of the crane 10. The counter weight 15 is disposed on the rear end of the upper swing body 12. The counter weight 15 is a deadweight which keeps balance of the crane 10.

The boom 16 is mounted on the front end side of the upper swing body 12 to be raised and lowered. In more detail, the boom 16 includes a distal end 16A (see FIG. 1) and a proximal end 16B by which the boom 16 is pivotably supported on the crane body 11. The boom 16 extends in a predetermined longitudinal direction. A boom foot 16S having a form of a bearing is provided on the proximal end 16B of the boom 16. The boom foot 16S is pivotably supported with a pin in the bearing (not shown) provided on the upper swing body 12. Although the detail of the structure of the boom 16 is not illustrated in FIG. 1, the boom 16 according to the embodiment has a known lattice structure. The structure of the boom 16 is not limited to a lattice structure.

The lattice mast 17 is pivotably supported on the upper swing body 12 in the rear side of the boom 16. The lattice mast 17 has a proximal end and a swing end. The proximal end is pivotably coupled to the upper swing body 12 in the rear side of the boom 16. Although, there is no limitation in a particular structure of the mast, the lattice mast 17 according to the embodiment has a lattice structure. A pivot shaft of the lattice mast 17 is parallel to a pivot shaft of the boom 16 and located near and in the rear side of the pivot shaft of the boom 16. In other words, the proximal end of the lattice mast 17 can pivot in the same direction as the raising and lowering direction of the boom 16. Meanwhile, the swing end of the lattice mast 17 is coupled to the distal end 16A of the boom 16 by a boom raising rope 26 and a guylink 37, which will be described later. With this coupling, the lattice mast 17 serves as a supporting pillar for pivoting the boom 16.

The box mast 18 includes a proximal end and a swing end. The proximal end is pivotably coupled to the upper swing body 12 in the rear side of the lattice mast 17. The box mast 18 has a rectangular cross section. The pivot shaft of the box mast 18 is parallel to the pivot shaft of the boom 16 and located near and in the rear side of the pivot shaft of the lattice mast 17. In other words, the box mast 18 is allowed to pivot in the same direction as the raising and lowering direction of the boom 16. The swing end of the box mast 18 is coupled to the distal end of the lattice mast 17 by a pair of right and left guylinks 22. With this coupling, the lattice mast 17 pivots in conjunction with pivoting of the box mast 18.

Various winches are mounted on the crane 10. Specifically, the mounted winches are a mast winch 18S for pivoting the box mast 18 for raising and lowering the lattice mast 17, a boom winch 23 for raising and lowering the boom 16, a main winch 24 for winding up and winding out a rope to lift and lower a cargo, and a mid-support winch 25 for suppressing the warp of the boom 16. In the crane 10 according to the embodiment, the mast winch 18S is mounted near the proximal end of the box mast 18 and the boom winch 23 is mounted near the proximal end of the lattice mast 17. The main winch 24 and the mid-support winch 25 are both mounted near the proximal end 16B of the boom 16. The winches 18S, 23, 24, and 25 may be mounted on the upper swing body 12.

The mast winch 18S winds up and winds out the mast rope 21. The mast rope 21 runs along such a route that causes the box mast 18 to pivot by winding up or out the mast rope 21. Specifically, sheave blocks 19 and 20 each of which including a plurality of sheaves arranged in the width direction are provided, respectively, on the rear end of the upper swing body 12 and the swing end of the box mast 18. The mast rope 21 is pulled out from the mast winch 18S and runs across the sheave blocks 19 and 20. With this configuration, the mast winch 18S winds up or winds out the mast rope 21 to change the distance between the sheave blocks 19 and 20 and thereby the box mast 18 and the lattice mast 17 pivot in conjunction in the raising and lowering direction. The box mast 18 and the lattice mast 17 are pivoted during assembling of the crane 10. That is, the box mast 18 and the lattice mast 17 are in each substantially fixed position when the crane 10 is in an operating position illustrated in FIG. 1.

The boom winch 23 winds up and winds out the boom rope 26. The boom raising rope 26 runs along such a route that causes the boom 16 to pivot by winding up and winding out the boom rope 26. Specifically, a lower spreader 35 and an upper spreader 36 each of which including a plurality of sheaves arranged in the width direction are provided, respectively, near the swing end of the lattice mast 17 and on the rear end of the guylink 37. The boom rope 26 is wound out from the boom winch 23 and runs about the sheave 33 and the sheave 34 and then across the lower spreader 35 and the upper spreader 36. With this configuration, the boom winch 23 winds up or winds out the boom rope 26 to change the distance between the lower spreader 35 and the upper spreader 36 and thereby the boom 16 coupled to the guylink 37 pivots in the raising and lowering direction.

The guylink 37 (connecting member) includes a first end 37A connected to the distal end 16A of the boom 16 and a second end 37B on the opposite side of the first end 37A (see FIG. 1). The connecting member of the present invention is not limited to a link but may take a different form, such as a wire. The lattice mast 17, the boom winch 23, the lower spreader 35, the upper spreader 36, and the boom rope 26 constitute a pull unit 41 of the present invention (see FIG. 1). The pull unit 41 is connected to the second end 37B to pull the guylink 37. The guylink 37 and the pull unit 41 constitute a raising device 42 of the present invention. The raising device 42 adjusts the force with which the guylink 37 pulls the boom 16 to raise and lower the boom 16.

The main winch 24 winds up and winds out the main rope 27 connected to the cargo. Regarding winding of the main rope 27, a main guide sheave 29 is rotatably provided on the distal end of the boom 16 and a main sheave block including a plurality of main point sheaves 30 arranged in the width direction is provided adjacent to the main guide sheave 29. The main rope 27 is hung from the distal end 16A of the boom 16 to lift the cargo. The main rope 27 is pulled out from the main winch 24 to run about the main guide sheave 29 and across the main point sheave 30 of the sheave block and the sheave 31S of a sheave block provided on a hook 31 for lifting the cargo. The main winch 24 winds up and winds out the main rope 27 to change the distance between the sheaves 30 and 31 and thereby the hook 31 coupled to the main rope 27 hung from the distal end 16A of the boom 16 moves in the vertical direction to lift and lower the cargo.

When the long boom 16 is set in an upright position as illustrated in FIG. 1, the boom 16 warps by some degree by its own weight. As illustrated in FIG. 1, the boom 16 warps by some degree along the longitudinal direction in a manner that the middle portion of the boom 16 swells to the front side (as illustrated using a dashed line in FIG. 1). From this state, when the cargo is lifted by the hook 31 from the ground G, a downward load is applied to the distal end of the boom 16. A compression force (an arrow DT) is thereby applied to the distal end of the boom 16 along the longitudinal direction. At the same time, a bending moment (a curved arrow DM) is produced in the longitudinally middle portion of the boom 16. Such a bending moment produced in the middle portion of the boom 16 causes a large load on a pipe member that constitutes the boom 16 and may damage the boom 16 or shorten the life of the boom 16.

Figure 2:
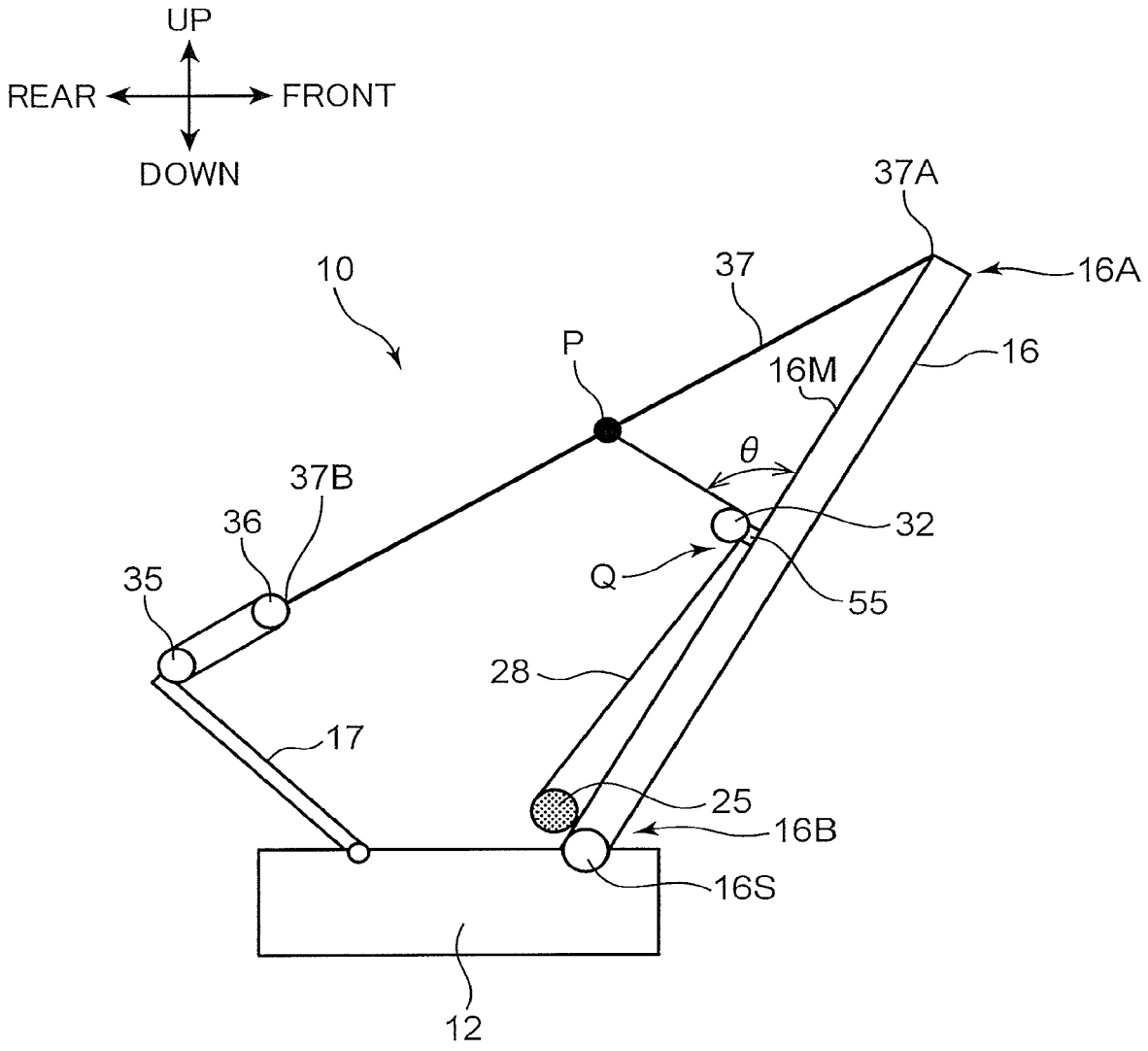
FIG. 2 is a schematic view for illustrating a mid-support structure of a raising member of the crane according to an embodiment of the present invention.
Figure 3:
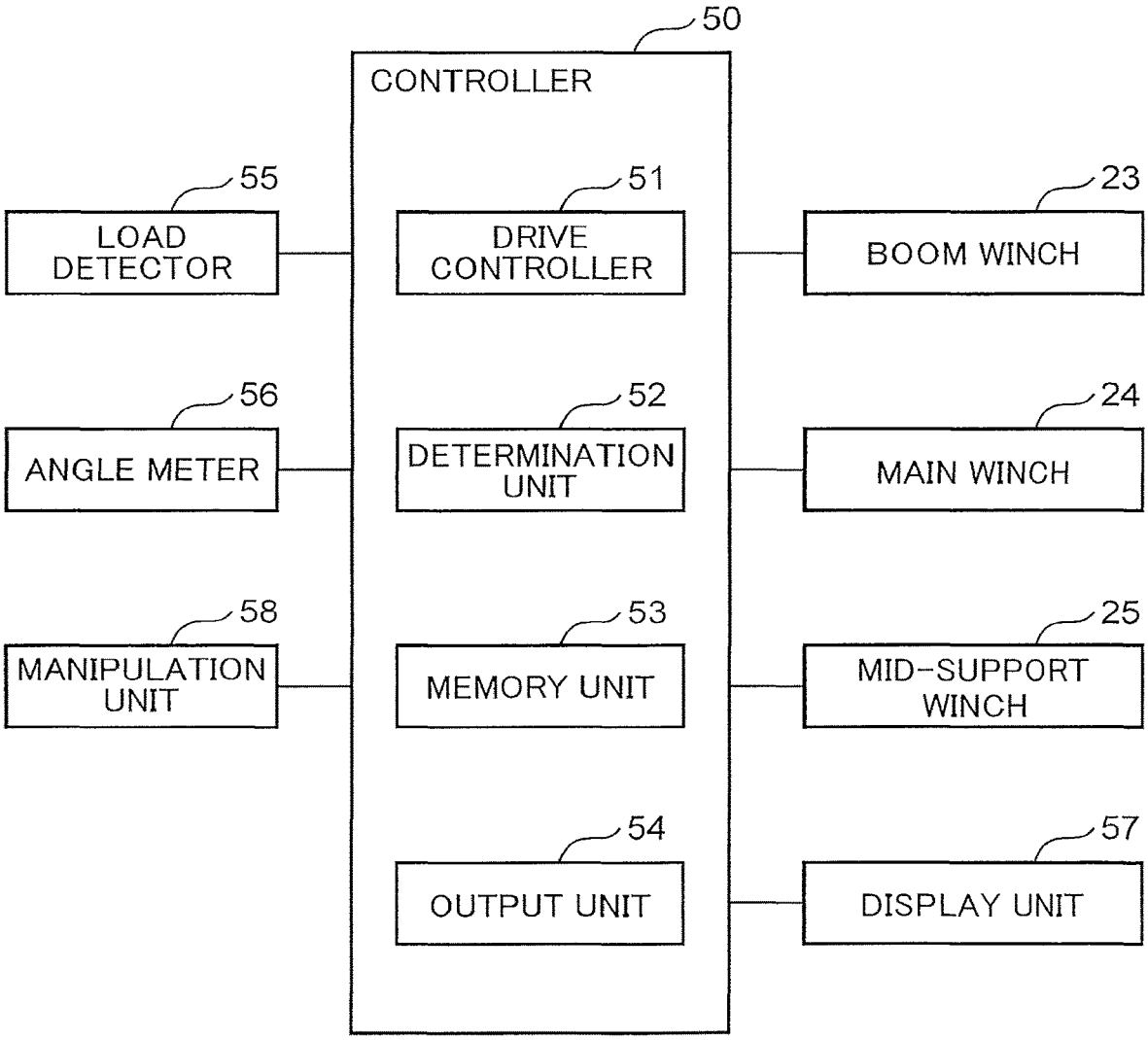
FIG. 3 is an electric block diagram of a controller included in the crane according to an embodiment of the present invention.

To solve such a problem, the embodiment is provided with the boom 16 having a mid-support structure. FIG. 2 is a schematic view for illustrating the mid-support structure of the boom 16 of the crane 10 according to the embodiment. FIG. 3 is an electric block diagram of a controller 50 of the crane 10 according to the embodiment.

As illustrated in FIGS. 1 to 3, the boom 16 includes not only the mid-support winch 25 but a mid-support rope 28, a mid-support sheave 32, the controller 50, a load detector 55, an angle meter 56, a display unit 57, and a manipulation unit 58.

The mid-support winch 25 winds up and winds out the mid-support rope 28. The mid-support rope 28 runs along such a route that changes the warp of the boom 16 by winding up and winding out the mid-support rope 28. Specifically, the mid-support sheave 32 is provided on the middle portion of the boom 16 so as to oppose the guylink 37. The mid-support rope 28 pulled out from the mid-support winch 25 runs about the mid-support sheave 32 and is secured to the guylink 37 at a securing end P. The mid-support winch 25 winds up and winds out the mid-support rope 28 to change the distance between the guylink 37 and the mid-support sheave 32 on the boom 16 to adjust the warp of the boom 16. The mid-support sheave 32 constitutes a constraining unit of the present invention. The constraining unit is disposed on the middle portion of the boom 16 to constrain the mid-support rope 28. In the present invention, the middle portion of the boom 16 corresponds to a section of the boom 16 between the distal end 16A and the proximal end 16B.

The mid-support rope 28 is, in other words, a rope that connects the middle portion of the boom 16 to the guylink 37. The mid-support rope 28 includes a securing end P and a held portion Q (see FIG. 2). The securing end P is a distal end of the mid-support rope 28 secured to the guylink 37 at a location between the first end 37A and the second end 37B. The held portion Q is a portion extending from the securing end P toward the boom 16 to be held by the mid-support sheave 32 on the boom 16 at a location between the distal end 16A and the proximal end 16B. The mid-support sheave 32 is provided on the middle portion of the boom 16 to oppose the guylink 37 to stretch the held portion Q of the mid-support rope 28. The mid-support winch 25 is disposed on the proximal end 16B of the boom 16 and winds up and winds out the mid-support rope 28 that is stretched by the mid-support sheave 32 at the held portion Q to be further pulled and extended downward. The mid-support winch 25 may be provided on the crane body 11.

As illustrated in FIG. 2, the securing end P and the held portion Q (the mid-support sheave 32) of the mid-support rope 28 are desirably positioned so as the angle θ between a side face 16M of the boom 16 and the section of the mid-support rope 28 between the securing end P and the held portion Q to be approximately 90 degrees, where the side face 16 M extends from the distal end A and the proximal end B in the longitudinal direction of the boom 16.

The controller 50 totally controls the operation of the crane 10. As illustrated in FIG. 3, the controller 50 is electrically connected to components, such as the load detector 55, the angle meter 56, the manipulation unit 58, the boom winch 23, the main winch 24, the mid-support winch 25, and the display unit 57 to transmit and receive control signals. The controller 50 is electrically connected also to other units included in the crane 10.

As illustrated in FIG. 2, the load detector 55 is disposed near the mid-support sheave 32. The load detector 55 detects a tensional force T of the mid-support rope 28. The tensional force T detected by the load detector 55 is referred by a determination unit 52 of the controller 50. The load detector 55 constitutes a characteristic value detector of the present invention. The characteristic value detector detects a characteristic value of the mid-support rope 28 that changes with the change in the degree of warp of the boom 16. That is, the load detector 55 detects the tensional force T of the mid-support rope 28 as a characteristic value.

The angle meter 56 is disposed on the proximal end of the boom 16 and detects the angle of the boom 16 to the ground (raised angle, namely, the angle between a longitudinal center line of the boom 16 and a horizontal line).

The display unit 57 is provided inside the cab 14 illustrated in FIG. 1 to present to an operator various kinds of information related to controlling of warp of the boom performed by the controller 50. In particular, the display unit 57 displays the degree of warp of the boom 16 output by an output unit 54 which will be described later.

The manipulation unit 58 is provided inside the cab 14 to receive an instruction for manipulating the main winch 24 and the mid-support winch 25. The manipulation unit 58 includes a plurality of manipulation levers.

The controller 50 includes a central processing unit (CPU), a read only memory (ROM) that stores a control program, and a random access memory (RAM) used as a work space for the CPU. The CPU performs the control program to execute functions of a drive controller 51, the determination unit 52, a memory unit 53, and the output unit 54.

The drive controller 51 outputs output signals for driving the boom winch 23, the main winch 24, and the mid-support winch 25. When an automatic-control mode is performed for the crane 10 to adjust the warp of the boom 16, the drive controller 51 controls the mid-support winch 25 to automatically wind up or wind out the mid-support rope 28.

The determination unit 52 compares the tensional force T of the mid-support rope 28 detected by the load detector 55 with the target value of the tensional force stored in the memory unit 53 to make determination.

The memory unit 53 stores in advance the relationship between the warp degree of the boom 16 and the tensional force T of the mid-support rope 28. For example, the memory unit 53 stores such information that the tensional force T of the mid-support rope 28 is 20 tons when the warp degree of the boom 16 illustrated using the dashed line in FIG. 1 is 1 m and the tensional force T of the tensional force is 10 tons when the warp degree of the boom 16 is 2 m. The information indicates that the warp degree of the boom 16 can be reduced from 2 m to 1 m by winding up the mid-support rope 28 by the mid-support winch 25 to increase the tensional force of the mid-support rope 28 from 10 tons to 20 tons, and in this manner, winding up and winding out of the mid-support rope 28 by the mid-support winch 25 can be controlled. Such kind of information indicating the relationship between the warp degree of the boom 16 and the tensional force T of the mid-support rope 28 is stored in the memory unit 53 for each raised angle of the boom 16.

The memory unit 53 stores in advance a target value of the tensional force T that achieves zero warp degree of the boom 16.

The output unit 54 outputs the warp degree of the boom 16 stored in the memory unit 53 corresponding to the tensional force T detected by the load detector 55. The warp degree that is output is displayed on the display unit 57.

As illustrated in FIGS. 1 to 3, the boom 16 raised above the crane body 11 by a winding operation of the boom winch 23 warps by its own weight as illustrated using the dashed line in FIG. 1. As described above, if the load of the cargo is applied to the distal end of the boom 16 in this state, a large bending moment (the curved arrow DM) is produced. Thus, it is desirable to correct the warp of the boom 16 before lifting the cargo.

In the embodiment, the load detector 55 detects the tensional force T of the mid-support rope 28 when an operator executes controlling of the warp of the boom 16. The output unit 54 outputs the warp degree of the boom 16 stored in the memory unit 53 that corresponds to the tensional force T detected by the load detector 55. The warp degree of the boom 16 output by the load detector 55 is displayed on the display unit 57 (see FIG. 3) in the cab 14 (see FIG. 1).

The operator checks the information on the warp degree of the boom 16 displayed on the display unit 57 and manipulates the manipulation unit 58 to perform winding up by the mid-support winch 25 (see FIG. 2). As the tensional force T changes by winding up performed by the mid-support winch 25, the warp degree of the boom 16 is updated and displayed on the display unit 57. The operator in the cab 14 can thus adjust the warp degree of the boom 16 to approximately zero. This adjustment of the warp degree of the boom 16 is applicable not only for the warp caused by the weight of the boom 16. If the boom 16 lifts the cargo and warps again by the weight of the cargo, the mid-support winch 25 is controlled to adjust the tensional force T (length) of the mid-support rope 28 and thereby the warp of the boom 16 is adjusted. In some cases, winding up of the mid-support rope 28 by the mid-support winch 25 causes the guylink 37 to bend at the securing end P. In such a case, the distance between the securing end P and the mid-support sheave 32 changes, keeping balance among tensional forces of three lines extending from the securing end P, to adjust the warp of the boom 16. In such a manner, the embodiment can adjust the warp of the boom 16 based on the tensional force T of the mid-support rope 28. Moreover, the warp of the boom 16 can be adjusted by manipulation of the operator performed through the manipulation unit 58.

In another embodiment, an automatic-control mode in which the drive controller 51 of the controller 50 controls winding up and winding out of the mid-support winch 25 may be provided. As described above, the memory unit 53 stores in advance a target value of the tensional force T set so as to approach approximately zero warp of the boom 16. It may be configured that the drive controller 51 controls the mid-support winch 25 to wind up or wind out the mid-support rope 28 so as the tensional force T of the mid-support rope 28 detected by the load detector 55 to approach the target value. Also in this case, it is desirable that the warp degree of the boom 16 is displayed on the display unit 57 (see FIG. 3) in the cab 14 (see FIG. 1) so that the operator can check the current warp degree of the boom 16. In this manner, the drive controller 51 can assist adjustment of the warp of the boom 16.

According to the embodiment, the boom 16 of the crane 10 can be raised and lowered by the raising device 42 (see FIG. 1). A predetermined cargo is lifted by the main rope 27 hung from the distal end 16A of the boom 16 by winding up the main rope 27 by the main winch 24. If the boom 16 may warp by its own weight or the load of the cargo, the distance between the securing end P of the mid-support rope 28 and the boom 16 can be adjusted by operating the mid-support winch 25 through the manipulation unit 58. Consequently, the warp of the boom 16 can be adjusted according to a posture of the boom 16 and load of the cargo. This suppresses a large compression force and a large bending moment applied on the boom 16 and damages to the boom 16 during an operation. The operator operates the mid-support winch 25 based on the warp degree of the boom 16 displayed on the display unit 57 to adjust the warp of the boom 16.

Moreover, in the embodiment, the tensional force T (the distance between the securing end P and the mid-support sheave 32 in FIG. 2) of the mid-support rope 28 can be adjusted by controlling the mid-support winch 25, so that, in such a case that the boom 16 warps in the direction opposite the dashed line in FIG. 1, the warp can be reduced by winding out the mid-support rope 28.

In the embodiment, the mid-support winch 25 illustrated in FIG. 2 can wind up the mid-support rope 28 along the longitudinal direction of the boom 16 to adjust the distance between the securing end P of the mid-support rope 28 and the raising member 16, thereby adjusting the warp of the boom 16. Since the mid-support winch 25 is disposed on the proximal end of the boom 16, the maintenance of the winch can be performed easily.

With reference to FIG. 1, the boom 16 is lowered to the front side of the crane body 11 to lie against the ground G during assembling of the crane 10. The boom winch 23 winds out the boom raising rope 26 to lower the boom 16 to the front side from the state illustrated in FIG. 1. To raise the boom 16 from the lowered posture to a raised posture as illustrated in FIG. 1, the boom raising rope 26 needs to be wound up by the boom winch 23. The boom 16 lying against the ground G warps to become downward convex by a large portion of its own weight in the middle portion of the boom 16. When the boom winch 23 winds up the boom raising rope 26 in this state to raise the boom 16, a tensional force of the guylink 37 creates a large compression force and a large bending moment in the boom 16. In the embodiment, the mid-support winch 25 is controlled to adjust the length of the mid-support rope 28 before raising the boom 16, so that the warp of the boom 16 caused by its own weight is reduced during raising and generation of the bending moment is suppressed.

The crane 10 according to the embodiment of the present invention is described above. The present invention is not limited to the configuration described above. Modified embodiments of the present invention can be made as described below.

(1) In the embodiment described above, the operator checks the tensional force T of the mid-support rope 28 detected by the load detector 55 to drive the mid-support winch 25 or alternatively, the drive controller 51 of the controller 50 drives the mid-support winch 25. The present invention is not limited to such a configuration. The characteristic value detector according to the present invention may detect a different characteristic value of the boom 16 or the mid-support rope 28 that changes with the change in the warp degree of the boom 16.

For example, strain gauges may be provided in advance in a plurality of places on the boom 16 and the mid-support winch 25 may be driven based on outputs from the strain gauges (strains in the boom 16, which are characteristic values). When the boom 16 has a rectangular cross section (has a form of a square pillar), strain gauges may be provided in the longitudinally middle portion of the boom 16 on four side faces of the boom 16. In this case, for the boom 16 warped in the shape illustrated using the arced dashed line in FIG. 1, the strain in the side face in the inner side of the arc is significantly different from the strain in the side face in the outer side of the arc. The winding up and winding out operations by the mid-support winch 25 may be controlled according to the warp of the boom 16 estimated based on the difference between strains. The linearity of the boom 16 detected by a known laser displacement meter may be used as the characteristic value of the boom 16.

Figure 4:
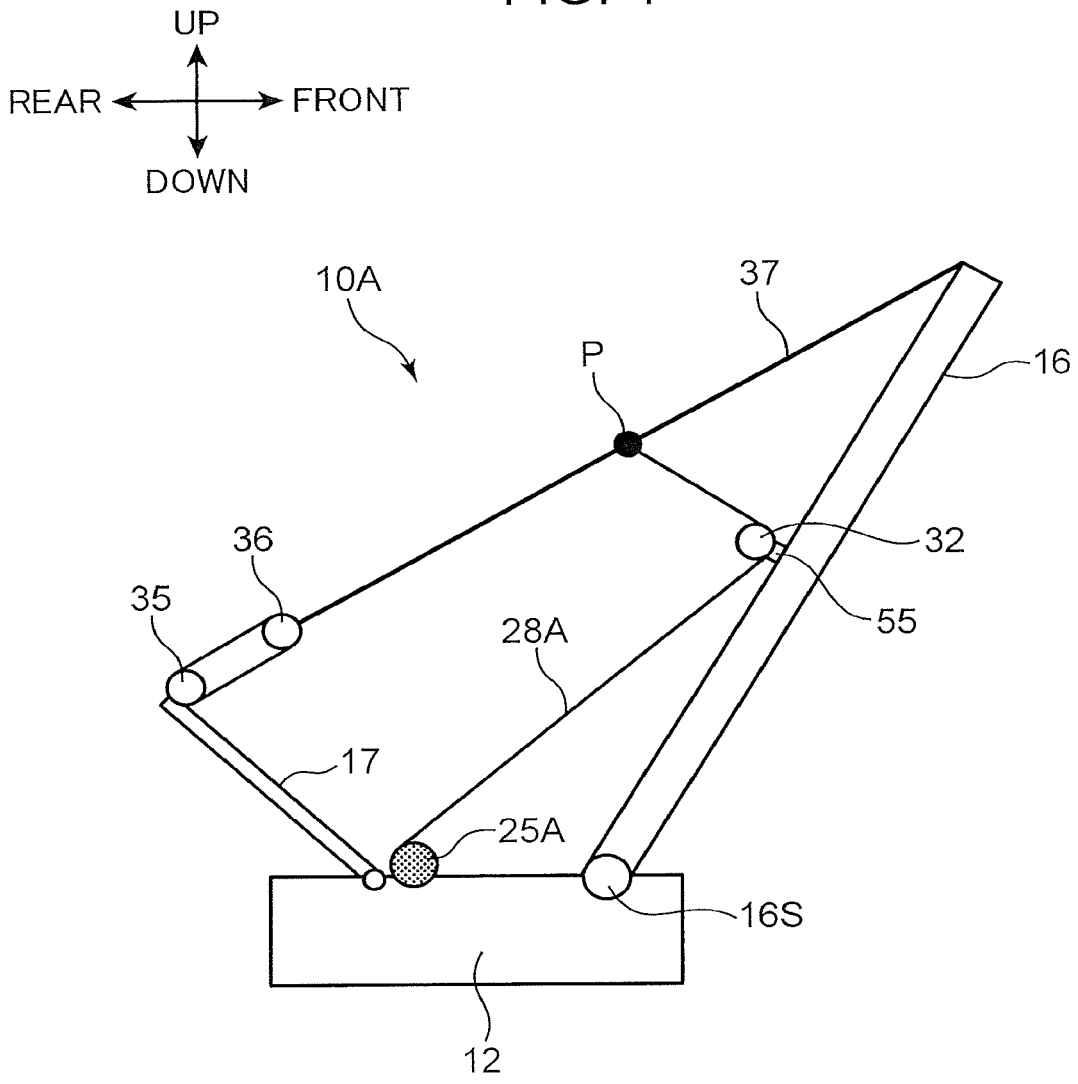
FIG. 4 is a schematic view for illustrating a mid-support structure of the raising member of a crane according to a modified embodiment of the present invention.
Figure 5:
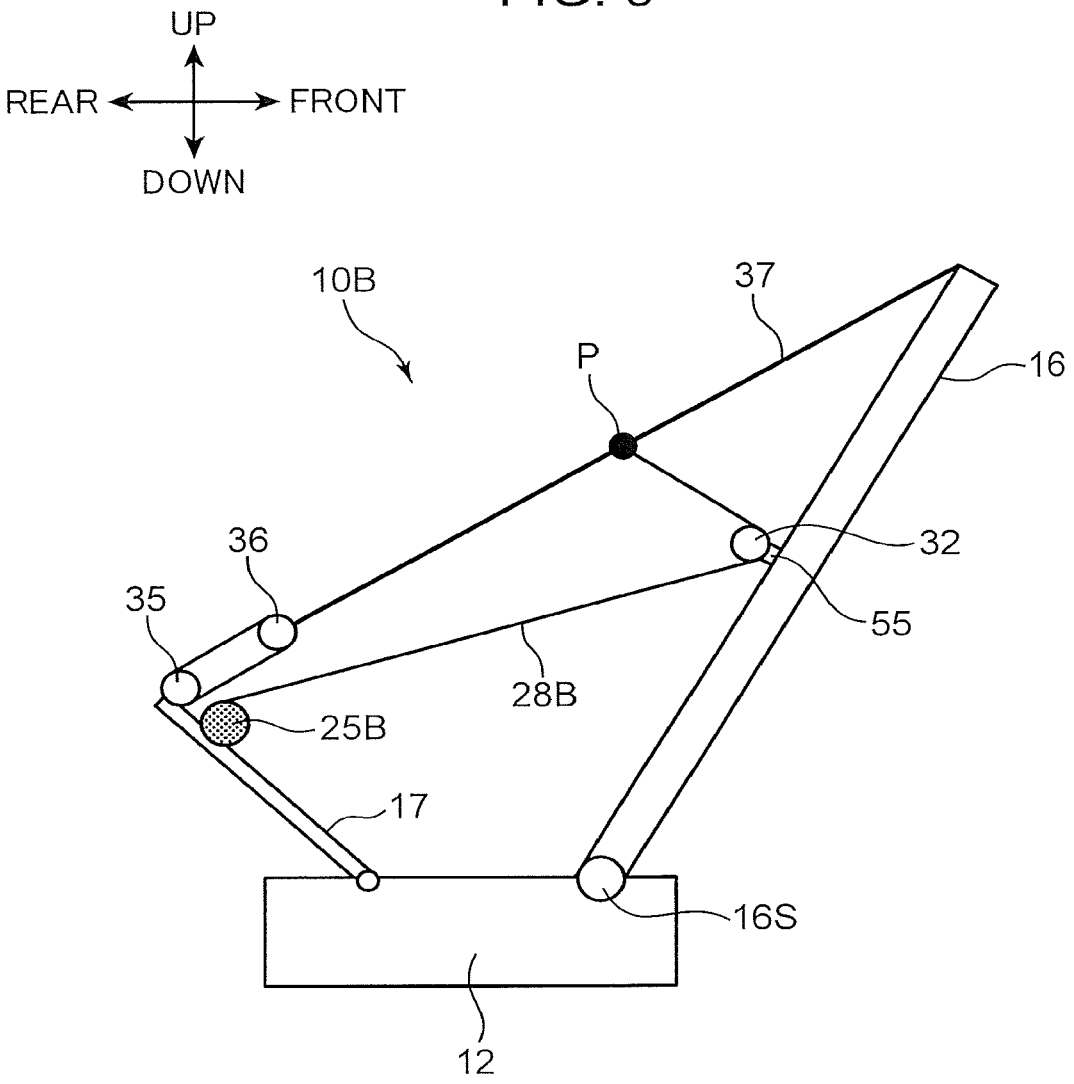
FIG. 5 is a schematic view for illustrating a mid-support structure of the raising member of a crane according to a modified embodiment of the present invention.
Figure 6:
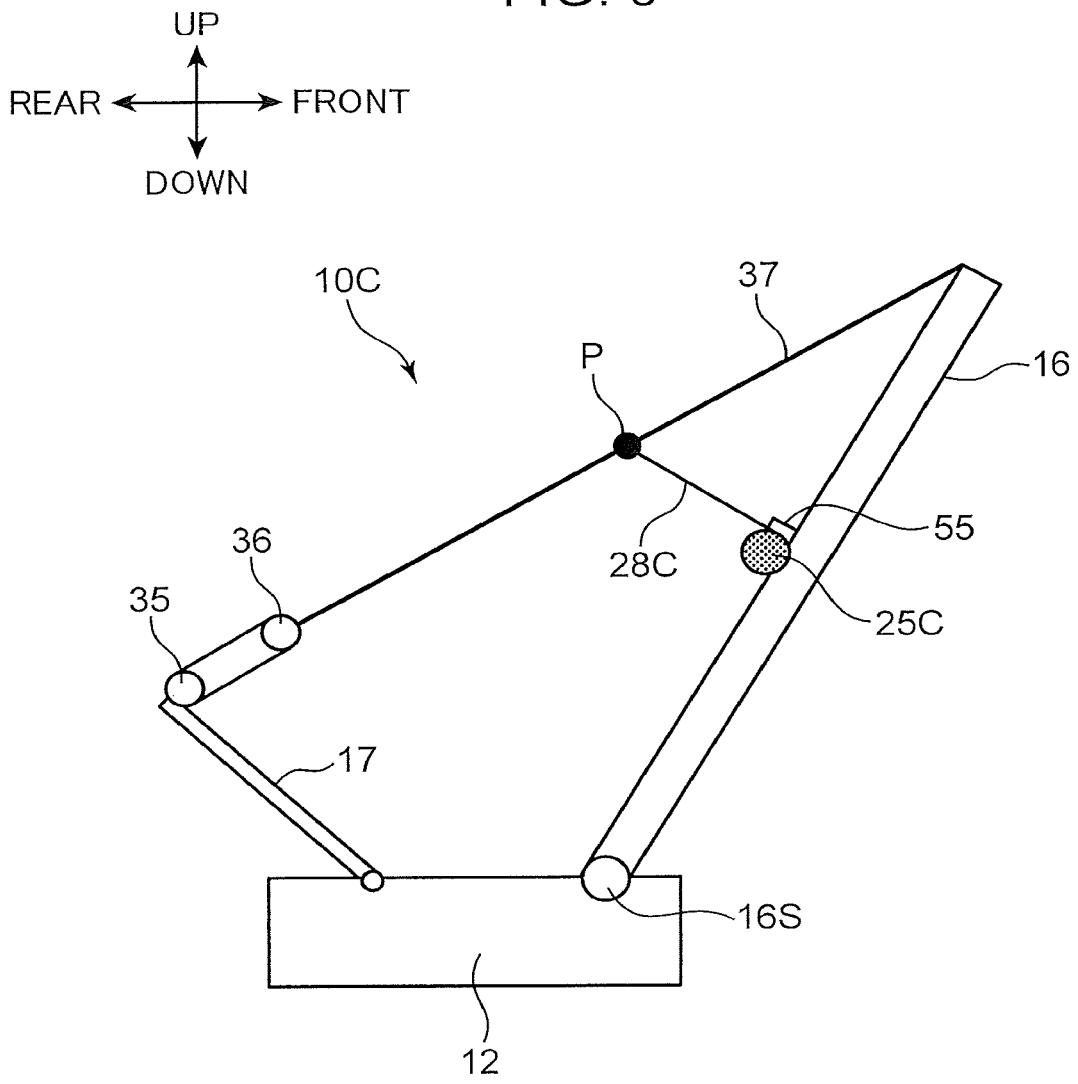
FIG. 6 is a schematic view for illustrating a mid-support structure of the raising member of a crane according to a modified embodiment of the present invention.

(2) In the embodiment, the mid-support winch 25 that winds up and winds out the mid-support rope 28 is disposed on the proximal end 16B of the boom 16. The present invention is not limited to such a configuration. FIGS. 4 to 6 are schematic views for illustrating the mid-support structure of the boom 16 of cranes 10A, 10B, and 10C according to embodiments of the present invention. In FIGS. 4 to 6, the member having the same function and structure as the embodiment described above is appended with the same reference sign as FIG. 2.

The crane 10A illustrated in FIG. 4 includes a mid-support winch 25A provided near the proximal end of the lattice mast 17. Similarly, the mid-support winch 25A winds up and winds out the mid-support rope 28A to adjust the length and the tensional force T of the mid-support rope 28A. An operator can perform maintenance of the mid-support winch 25A easily.

The crane 10B illustrated in FIG. 5 includes a mid-support winch 25B provided near the distal end of the lattice mast 17. Similarly, the mid-support winch 25B winds up and winds out the mid-support rope 28B to adjust the length and the tensional force T of the mid-support rope 28B. In this case, the mid-support rope 28B runs about the mid-support sheave 32 by a large angle and thus the middle portion (the portion with a large warp degree) of the boom 16 is pulled by a large force by winding up the mid-support rope 28B.

The crane 10 illustrated in FIG. 6 includes a mid-support winch 25C provided on the middle portion 16 of the boom 16. Namely, the crane 10C has no mid-support sheave 32 illustrated in FIG. 2. Similarly, the mid-support winch 25C winds up and winds out the mid-support rope 28C to adjust the length and the tensional force T of the mid-support rope 28C. Since the mid-support winch 25C is provided on an end of the mid-support rope 28, the mid-support winch 25C pulls the securing end P of the mid-support rope 28 with a large force. In this embodiment, the outer periphery of the mid-support winch 25C serves as the constraining unit of the present invention.

Figure 7:
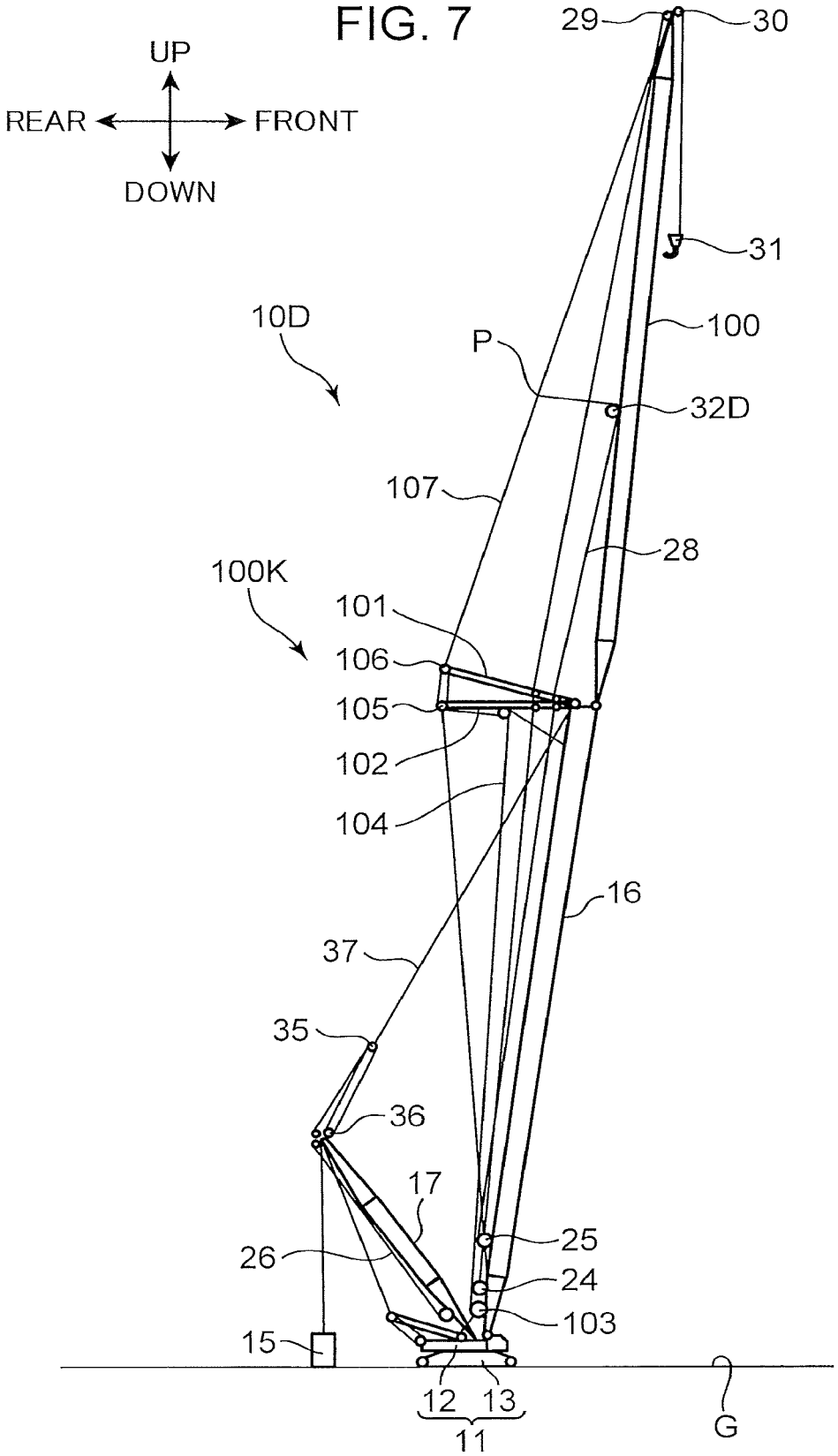
FIG. 7 is a side view of a crane according to a modified embodiment of the present invention.

(3) In the embodiments described above, the crane 10 includes the boom 16 and only the warp of the boom 16 is adjusted. The present invention is not limited to such configurations. FIG. 7 is a side view of the crane 10D according to a modified embodiment of the present invention. In this modified embodiment, a jib 100 is mounted on the distal end of a boom 16 to be raised and lowered. The crane 10D includes not only the jib 100 (raising member) but a front strut 101, a rear strut 102, a jib winch 103, a jib rope 104, a sheave blocks 105 and 106, and a guylink 107. The jib rope 104 pulled out from the jib winch 103 runs about and across the sheave block 105 and the sheave block 106 a plurality of times. The jib winch 103 winds up and winds out the jib rope 104 to change the distance between the front strut 101 and the rear strut 102. As a result, the jib 100 connected to the front strut 101 via the guylink 107 is raised.

In the modified embodiment, the mid-support rope 28 pulled out from the mid-support winch 25 runs about the mid-support sheave 32D disposed on a middle portion of the jib 100 and is secured to the middle portion of the guylink 107 (securing end P). The warp of the jib 100 caused by its own weight can be adjusted by winding up and winding out the mid-support rope 28 by the mid-support winch 25. In FIG. 7, the guylink 107 serves as the connecting member of the present invention, and the front strut 101, the rear strut 102, the jib winch 103, and the jib rope 104 constitute the pull unit of the present invention. The guylink 107 and the pull unit constitute a raising device 100K that raises and lowers the jib 100. In the modified embodiment, a crane body 11 and the boom 16 constitute the supporting body of the present invention.

This application is based on Japanese Patent application No. 2016-151382 filed in Japan Patent Office on Aug. 1, 2016, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A crane comprising:

a raising member including a distal end and a proximal end, and extending in a longitudinal direction;

a supporting body that supports the raising member to be raised and lowered; and a raising device that includes a guylink having a first end and a second end, the first end being connected to the distal end of the raising member, the second end being located in an opposite side of the first end, and a pull unit connected to the second end of the guylink to pull the guylink, the raising device being configured to adjust a force with which the guylink pulls the raising member and thus raising the raising member;

a lift rope hung from the distal end of the raising member to lift a cargo;

a lift winch that winds up and winds out the lift rope;

a mid-support rope that connects a middle portion of the raising member to the guylink and includes a securing end secured to the guylink at a point between the first end and the second end of the guylink, and a held portion extending from the securing end toward the raising member;

a constraining unit that is disposed on a middle portion of the raising member to constrain the held portion of the mid-support rope; and a mid-support winch that winds up and winds out the held portion of the mid-support rope to change a distance between the guylink and the constraining unit.

2. The crane according to claim 1, further comprising:

a characteristic value detector that detects a characteristic value of the raising member or the mid-support rope, the characteristic value changing with a change in a warp degree of the raising member that warps along a longitudinal direction by a weight of the raising member or a load of the cargo;

circuitry configured to store in advance a relationship between the warp degree of the raising member and the characteristic value and configured to output a warp degree of the raising member, the warp degree corresponding to the characteristic value detected by the characteristic value detector; and a display that displays the warp degree of the raising member of said output.

3. The crane according to claim 2, wherein the characteristic value detector includes a tensional force detector that detects a tensional force of the mid-support rope as the characteristic value.

4. The crane according to claim 2, further comprising:

a manipulation controller that receives an instruction for manipulating the raising device and the mid-support winch; and a winch controller that controls an operation of the raising device and winding up and winding out performed by the mid-support winch according to the instruction that the manipulation controller receives.

5. The crane according to claim 4, wherein the circuitry is configured to store in advance a target value of the characteristic value set so as to approach approximately zero warp degree of the raising member, and the winch controller has an automatic-control mode in which the mid-support winch is controlled to wind up and wind out the mid-support rope so as the characteristic value detected by the characteristic value detector to approach the target value.

6. The crane according to claim 1, wherein the constraining unit is a mid-support sheave disposed on the raising member to oppose the guylink and stretches the mid-support rope, and the mid-support winch is disposed on the proximal end of the raising member or on the supporting body so as to wind up and wind out the mid-support rope that is stretched by the mid-support sheave to be further pulled and extended downward.

* * * * *